United States Patent [19]

Labombarde

[11] Patent Number: 4,666,141

[45] Date of Patent: May 19, 1987

[54] APPARATUS AND METHOD FOR REVERSE ROLL FEED OF SHINGLED BLANKS

[76] Inventor: Raymond A. Labombarde, Daniel Webster Highway S., Nashua, N.H. 03061

[21] Appl. No.: 656,712

[22] Filed: Oct. 1, 1984

[51] Int. Cl.[4] ..... B65H 3/04

[52] U.S. Cl. ..... 271/35; 271/122; 271/151

[58] Field of Search ..... 271/35, 150, 151, 125, 271/122

[56] References Cited

U.S. PATENT DOCUMENTS

| | | | |
|---|---|---|---|
| 2,635,874 | 4/1953 | LaBore | 271/35 |
| 2,922,643 | 1/1960 | Lopez | 271/125 X |
| 4,046,369 | 9/1977 | Kluge | 271/151 X |

FOREIGN PATENT DOCUMENTS

| | | | |
|---|---|---|---|
| 95204 | 11/1983 | European Pat. Off. | 271/35 |
| 720442 | 3/1980 | U.S.S.R. | 271/35 |

OTHER PUBLICATIONS

Xerox Disclosure Journal, vol. 4, No. 5, Sep./Oct. 1979, pg. 629, 630, "Spring Gate . . . ", Danchak et al.

*Primary Examiner*—Richard A. Schacher
*Attorney, Agent, or Firm*—Pearson & Pearson

[57] ABSTRACT

An elongated, cylindrical roll, having a surface machined to a predetermined microfinish, is mounted in place of the conventional chromium plated fixed gate in a known type of blank feeder. In such feeders, the upper stretch of the conveyor advances blanks from a high stack, in a bottom feed magazine, along a path, in shingled formation to continuously resupply a low stack in the hopper of a folder-gluer. The elongated roll is reversely rotated, at a surface speed equal to the speed of the upper stretch. The leading edges of the lower most blanks in the high stack are barred by leaf springs from contacting the rear surface of the reversely rotating roll except for an arcuate area, in the lower rear quadrant, defined by an angle of 30° rearwardly from the bottom longitudinal center line of the roll.

10 Claims, 4 Drawing Figures

Fig. 3.
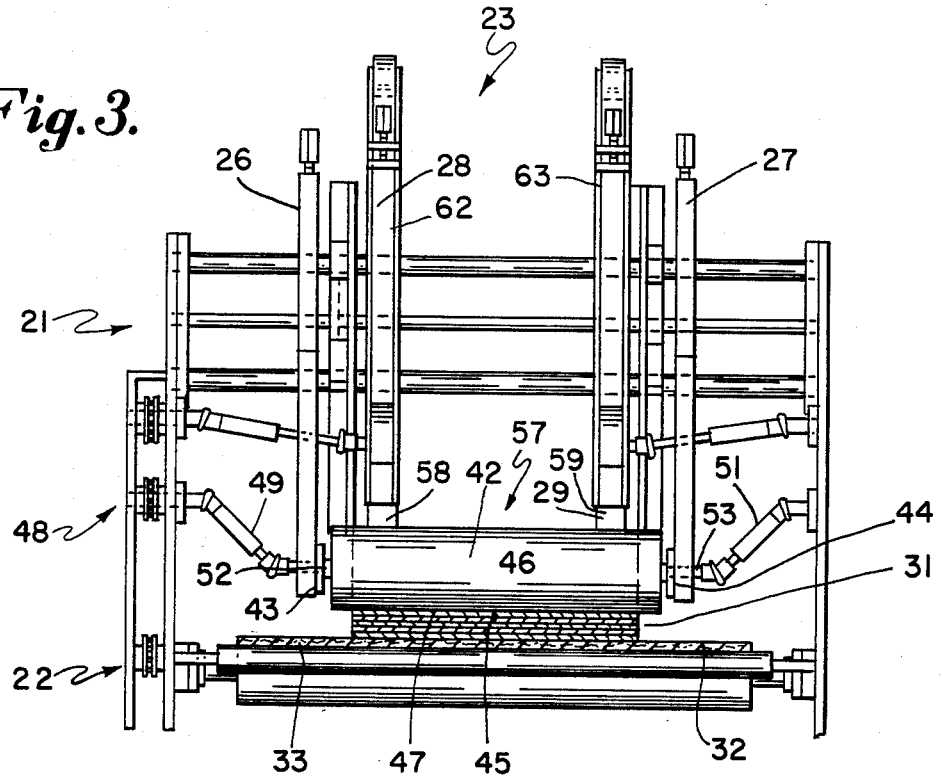
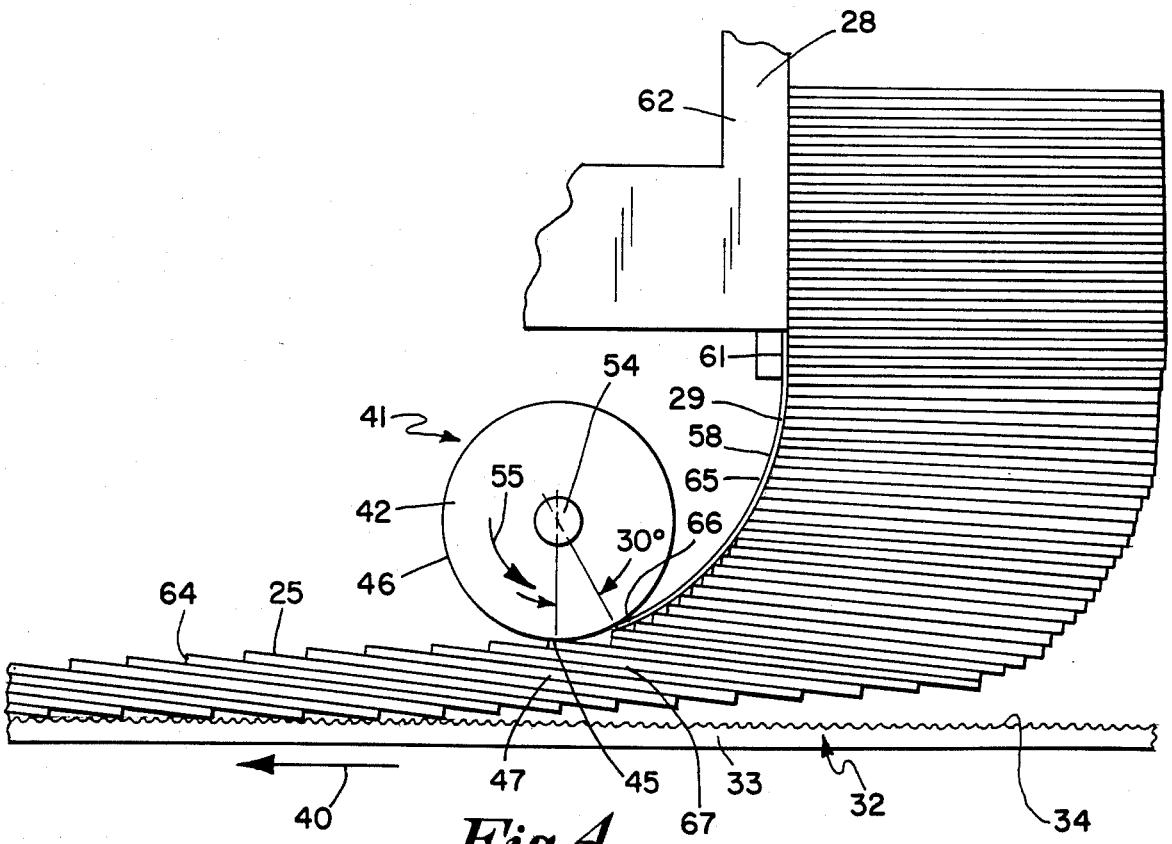
Fig. 4.

APPARATUS AND METHOD FOR REVERSE ROLL FEED OF SHINGLED BLANKS

BACKGROUND OF THE INVENTION

This invention relates to a known type of blank feeder, such as the M.I. "UNIFEEDER" made by Multifold-International, Inc., 750 Main Street, Milford, Ohio, 45150, or similar feeders made by others in the trade.

Such blank feeders are designed to maintain the blank hoppers of folder-gluers filled to a uniform height, on demand, thereby avoiding misfeeds, or non-feeds, due to overweight of blanks on the bottom feed mechanism of the hopper.

The blank magazine of the "Unifeeder" type device can be filled with a relatively high stack of flat blanks. The nodule surfaced conveyor belt advances under the open bottom of the magazine to urge the lower most blanks through a passage, or gateway, in the lower front wall, formed by the curved lower ends, of a set of vertical smooth bars, as the upper, immovable element, and by the upper stretch of the conveyor, as the lower, movable element.

The passage, or gateway, between the said elements is of predetermined height, capable of passing several thickness of blank at a time, so that the blanks may advance in shingled formation, along a path, with predetermined spacing, on the feed belt, until they are deposited in the hopper of the folder-gluer.

A constant uniform feed has been the objective of such feeders with no down time from jams, doubles, skips, surges or scuffing.

However, the fixed, vertical bars forming the immovable, curved, upper element of the blank passage, gateway or nip seems to have been a major cause of any such loss of production as may have occurred in machines of this type.

SUMMARY OF THE INVENTION

In this invention, the immovable, curved bar ends forming the upper elements of the blank passage, gateway, or nip, have been eliminated. Instead, an elongated, cylindrical roll has been rotatably mounted, just in advance of the opening in the lower front wall, to extend transversely of the blank path at a predetermined height above the upper stretch of the feed belt, to form a nip therewith. The surface of the roll is machined to a microfinish in the range of 50 to 150 microns and preferably to a microfinish of 63 , and the roll is of metal, preferably aluminum.

The elongated, cylindrical roll is continuously rotated at the same surface speed, at the nip, as the speed of the upper stretch of the feed belt, but in the opposite direction, so that the roll surface travels reversely and continuously urges the leading edges of the upper blanks entering the nip rearwardly while the bottom feed belt is continuously urging the lower most blanks in the magazine forwardly, while the machine is in operation.

Masking means is provided, in the form of a set of flexible, thin, leaf springs having upper ends affixed to the front wall of the magazine and thence depending downwardly and forwardly around the roll to terminal edges in contact with the roll surface at about 30 degrees in rear of the bottom longitudinal center line of the roll. This 30° arcuate contact has been found to be the preferred area for avoiding jamming, pile-up and damage in the nip.

BRIEF DESCRIPTION OF THE DRAWING

FIG. 3 is a front elevation of the portion of the blank feeder shown in FIG. 1; and FIG. 4 is an enlarged, diagrammatic, side elevation, showing the reversely rotating roll of the invention forming a nip, passage or gateway with the noduled feed belt and showing the leaf spring masking elements.

DESCRIPTION OF PREFERRED EMBODIMENT

Figure 1:
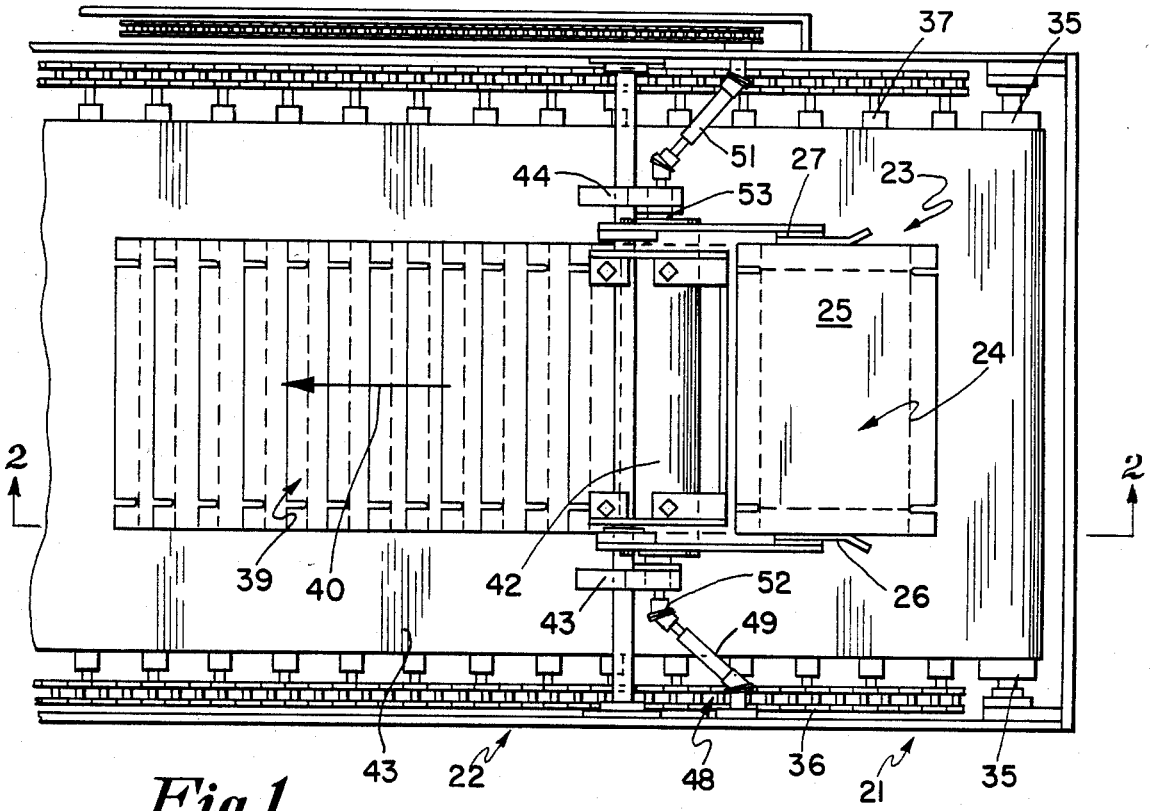
FIG. 1 is a top plan view of the magazine end of a blank feeder, for feeding folder gluers, with the roll of the invention invention installed therein.
Figure 2:
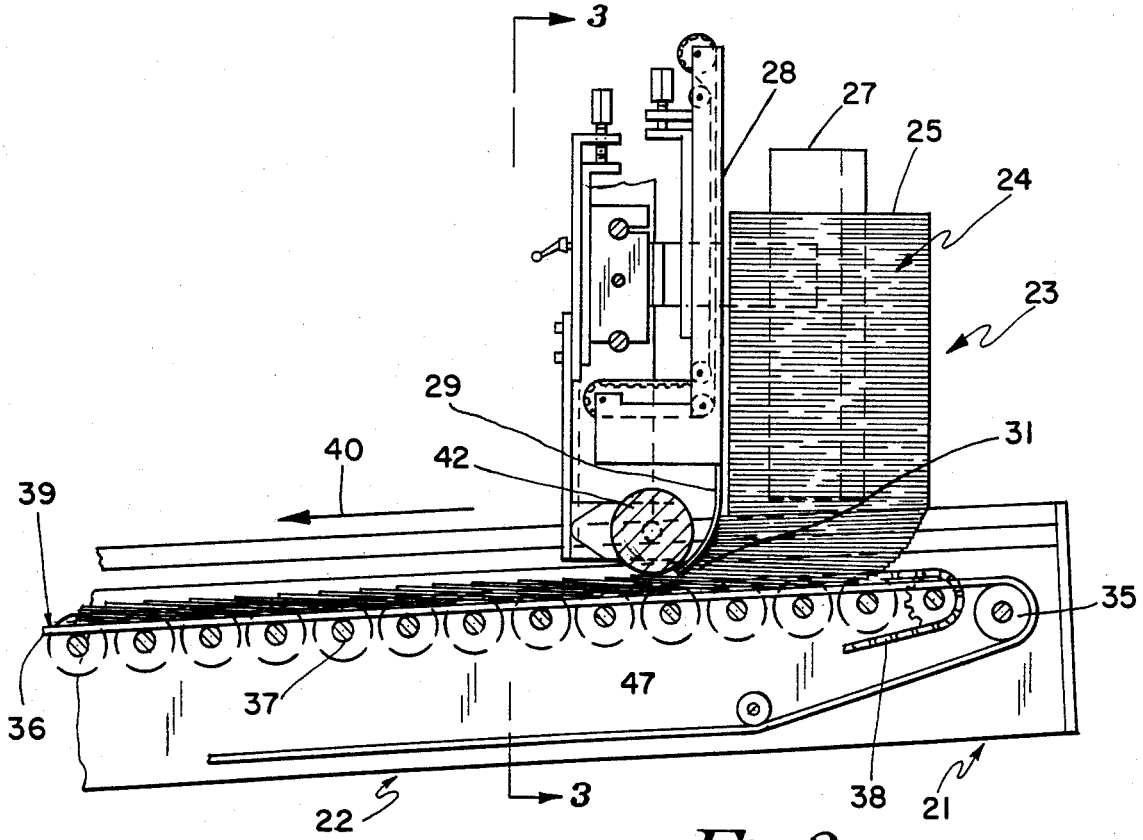
FIG. 2 is a side elevation of the portion of the blank feeder shown in FIG. 1.

In FIGS. 1, 2, and 3, the magazine end 21 of a typical blank feeder 22 is illustrated, the blank magazine 23 holding a relatively high, vertical, stack 24 of flat box blanks 25 contained within the opposite side walls 26 and 27 and front wall 28. A blank passage 29 is provided in the lower portion of front wall 28 and the magazine 23 is of the bottom feed type with an open bottom 31.

An endless conveyor 32 comprising a feed belt 33, with a noduled surface 34, is trained around suitable sheaves 35 and provided with an upper stretch 36 supported on rolls 37 and driven by motor driven chain 38, so that upper stretch 36 advances, at predetermined speed, under the stack 24, along the open bottom 31, and along the path 39 in the direction of the arrow 40.

In blank feeders of this type, the path 39 and the upper stretch 36 extends along the bottom 31, of the magazine 23, through the passage 29, with the blanks in shingled formation on the noduled surface 34, the path and stretch rising upwardly and then downwardly to deliver the shingled blanks into the hopper of a folder gluer, on demand and with the height of the stack in the hopper maintained low, but uniform, all as well known in the trade and, therefore, not illustrated.

As explained above, such shingled blank feeders have had several immovably affixed chromium plated, smooth metal, bars affixed vertically at spaced distances along the front wall of the magazine, each having a forwardly curved lower end with the tips thereof spaced above the feed belt to form a passage therewith, which will permit four or five thicknesses of blanks to be fed thereunder in shingled formation.

In this invention these stationary curved end bars have been eliminated. Instead, feed control means 41, including an elongated cylindrical roll 42 has been mounted slightly in advance of the blank passage 29, the roll 42 being journalled in suitable bearings 43 and 44. The roll 42 extends transversely of the path 39 and the lower central, longitudinal center line 45 of the circumferential surface 46 of the roll forms a nip 47 with the nodules surface 34 of the upper stretch 36 of the feed belt 33.

Drive means 48, for the roll 42, includes the telescopable drive shafts 49 and 51, each on an opposite side of the roll and each connected to one of the opposite ends 52 or 53 of the roll shaft 54. The height of the nip 47 is thus adjustable to pass the desired number of blanks 25 in shingled formation. As shown by the arrow 55, the roll 42 is rotated reversely by its drive means 48, connection to the chain and sprocket drive 38, which drives the feed belt 33 of the conveyor 32, so that the surface speed of the roll surface 46 is the same as the speed of the surface 34 of the upper stretch 36 at nip 47, but in the opposite direction.

The roll surface 46 is machined to a microfinish in the range of 50 to 150 microns, but preferably to a microfinish of 63 microns.

Mask means 57 includes a pair of leaf springs such as 58 and 59, each having its upper end 61 affixed to one of the subframes 62 or 63 of the conventional down travelling belts used in blank feeders along the front wall 28, to urge the leading edges 64 of the blanks 25 into horizontal configuration in case the blanks have become curved. Each leaf spring 58 or 59 extends downwardly and forwardly from its fixed end 61 in a curve 65 to a free terminal end 66, which contacts the roll surface 46 tangentially at an angular distance about 30° in rear of the longitudinal center line 45 of the roll 42. Thus, the leading edges 64 of the blanks 25 being urged through the nip 47 by the upper stretch 36, in shingled formation, as at 67, are masked from contacting the major portion of the rearwardly and upwardly travelling roll surface, but only contact a limited area of mainly rearwardly travelling rolls surface which urges them rearwardly while the belt urges the lower most blanks in the formation forwardly.

It has been found that if the roll 42 is stationary, a jam-up may occur, and if the roll 42 is rotated so that the surface 46 at the nip advances in the same direction as the feed belt, a jam may occur. However, when the roll 42 is rotated reversely, as described herein, no jams, doubles, or skips occur, and the blanks advance through the nip 47 in shingled formation with even spacing.

I claim:

1. A blank feeder for advancing a plurality of box blanks, in shingled formation, along a path into the hopper of a folder-gluer, said blank feeder comprising:

a blank magazine holding a vertical stack of flat box blanks, said magazine having side walls, an open bottom and a front wall with a blank passage in the lower portion thereof adapted to pass said blanks in shingled formation;

an endless conveyor having an upper stretch advancing along said path from under the open bottom of said magazine, through said hopper, and continuously delivering a plurality of shingled blanks from said magazine into said hopper at a predetermined speed; and feed control means, including a transversely elongated roll, rotatably mounted to extend entirely across said path, just in advance of said passage, and having a roll surface forming a nip with said upper stretch, drive means for rotating said roll reversely relative to the direction of advance of said upper stretch, and at least one leaf spring having an upper end affixed to the front wall of said magazine and thence depending downwardly and forwardly in a curve partly around the lower rear quadrant of said roll to a free terminal end in tangential contact with the surface of said roll, to mask the same, the remaining arcuate portion of the lower rear quadrant of the surface of said roll engaging the leading edges of the blanks, advanced into said nip by said endless conveyor, and continuously urging said blanks rearwardly to prevent jamming in said nip.

2. A blank feeder as specified in claim 1 wherein:

the arcuate portion of said rear quadrant of the surface of said roll which engages said leading edges of said blanks is about an angular distance of thirty degrees in the lower portion of the rear quadrant of said reversely rotating roll.

3. A feeder as specified in claim 1 wherein:

the surface of said roll is machined to a microfinish in the range of 50 microns to 150 microns.

4. A feeder as specified in claim 1 wherein:

the surface of said roll is machined to about 63 microns.

5. A feeder as specified in claim 1 wherein:

the surface speed of said reversely rotating roll is substantially identical with the predetermined speed of advance of said upper stretch, but in the opposite direction.

6. The method of continuously advancing a plurality of flat box blanks, in shingled formation on the upper stretch of an endless conveyor, along a path from the bottom of a bottom feed magazine, through a passage in the front wall of the magazine and into the hopper of a folder gluer by means of a roller, said method including the steps of:

providing said roller with a circumferential surface having a microfinish in the range of 50 microns to 150 microns;

mounting said roller in said passage to form a nip with said upper stretch, capable of passing said blanks in said predetermined shingled formation;

masking the arcuate rear, upper, surface of said roll from contact with the leading edges of the flat blanks being urged through said nip by said upper stretch while exposing the lower rear arcuate surface thereof for an angle of about 30° into contact with said roll surface; and reversely rotating said roll, at substantially the same speed as the speed of advance of said upper stretch, but in the opposite direction so as to continually urge said leading edges rearwardly away from said nip as said upper stretch urges the lower most shingled blanks forwardly.

7. A blank feeder of the type having an endless conveyor with an upper stretch continuously advancing a plurality of flat box blanks in shingled formation, at a predetermined speed, along a path from the bottom of a bottom feed magazine, through a passage in the lower front wall of the magazine, and into the hopper of a folder gluer, characterized by:

an elongated cylindrical roll, with a surface of predetermined microfinish, rotatably mounted in said passage to form a nip with said upper stretch through which said shingled formation may pass;

drive means for rotating said roll in a reverse direction so that the roll surface travels in a direction opposite to the direction of advance of said upper stretch at said nip;

and mask means, affixed to the front wall of said magazine and extending down and around the rear, lower quadrant of said roll to bar contact of the leading edges of said blanks with the surface of said roll except for contact with the lower, rear arcuate portion thereof, defined by an angular distance rearwardly of about 30° from the bottom longitudinal center line of said roll.

8. A blank feeder as specified in claim 7 wherein:

said roll surface is machined to a microfinish in the range of 50 microns to 150 microns.

9. A blank feeder as specified in claim 7 wherein:

said roll surface is machined to a microfinish of about 63 microns.

10. A blank feeder as specified in claim 7 wherein:

said drive means rotates said roll at the same surface speed as the speed of advance of said upper stretch, but in the opposite direction.

* * * * *